US008960148B2

(12) United States Patent
McGinnis

(10) Patent No.: US 8,960,148 B2
(45) Date of Patent: Feb. 24, 2015

(54) HEAT TRANSFERRING ENGINE VALVE FOR FUEL CONSERVATION

(71) Applicant: George McGinnis, Grand Blanc, MI (US)

(72) Inventor: George McGinnis, Grand Blanc, MI (US)

( * ) Notice: Subject to any disclaimer, the term of this patent is extended or adjusted under 35 U.S.C. 154(b) by 0 days.

(21) Appl. No.: 13/936,322

(22) Filed: Jul. 8, 2013

(65) Prior Publication Data

US 2014/0014057 A1 Jan. 16, 2014

Related U.S. Application Data

(60) Provisional application No. 61/741,021, filed on Jul. 11, 2012.

(51) Int. Cl.

| | |
|---|---|
| ***F02N 3/00*** | (2006.01) |
| ***F01L 1/34*** | (2006.01) |
| ***F01L 3/00*** | (2006.01) |
| ***F01L 3/20*** | (2006.01) |
| *F01L 3/02* | (2006.01) |

(52) U.S. Cl.

CPC ... *F01L 1/34* (2013.01); *F01L 3/00* (2013.01); *F01L 3/20* (2013.01); *F01L 3/02* (2013.01)

USPC ..... 123/188.2; 123/188.3

(58) Field of Classification Search

CPC ..... F02B 1/04; F02B 77/02; F02B 29/0493; F02M 31/042

USPC ..... 123/188.2, 188.3, 188.7; 29/888.4, 29/888.46

See application file for complete search history.

(56) References Cited

U.S. PATENT DOCUMENTS 2,154,871 A * 4/1939 Schlorf ..... 123/41.41

FOREIGN PATENT DOCUMENTS

JP 58096113 A * 6/1983

* cited by examiner

*Primary Examiner* — Noah Kamen

(74) *Attorney, Agent, or Firm* — Kohn & Associates PLLC

(57) ABSTRACT

A heat transferring engine valve for an internal combustion engine to increase the combustion efficiency and fuel economy of the engine. The heat transferring valve includes a valve head and a heat transferring member situated at the combustion surface of the valve head and extending toward the combustion chamber. The heat transferring member absorbs heat of combustion during the power stroke of an engine cycle and releases the heat into the combustion chamber during the compression stroke of a succeeding engine cycle, thereby raising the temperature of fuel at the start of combustion. A method for increasing the efficiency of combustion in an internal combustion engine by incorporating at least one heat transferring valve into the engine.

11 Claims, 5 Drawing Sheets

HEAT TRANSFERRING ENGINE VALVE FOR FUEL CONSERVATION

TECHNICAL FIELD

The present invention relates to the field of internal combustion engines and in particular to the improvement of engine combustion efficiency with fuel-conserving, heat transferring engine valves.

BACKGROUND OF THE INVENTION

The gas mileage, power output, and emissions produced by an internal combustion engine depend in large part on the combustion efficiency of the engine, that is, the completeness of oxidation of a hydrocarbon fuel to carbon dioxide, water, and heat. Most internal combustion engines operate at far less than maximal efficiency and therefore achieve sub-maximal gas mileage, produce sub-optimal power, and emit high levels of emissions in the form of unburned fuel, carbon monoxide, and oxides of nitrogen. A well known strategy for increasing the efficiency and mileage of an internal combustion engine is to raise the temperature of the gas mixture present in the combustion chamber during the compression stroke of an engine cycle.

Several inventions have been disclosed to raise combustion chamber temperature through a heat transfer process, in which heat generated by combustion during the power stroke of an engine cycle is transferred directly or indirectly to the combustion chamber during the compression stroke. European Patent No. EP0717183 to Clarke discloses a moveable, permeable, disc-shaped regenerator which is situated within the cylinder of an internal combustion engine, between the piston and cylinder head. The regenerator oscillates on its own shaft, in a direction parallel to the movement of the cylinder. The regenerator absorbs heat from hot combustion gasses and transfers it to cool fresh air entering through an intake valve.

U.S. Pat. No. 6,340,004 to Patton discloses an engine in which the functions of an engine cycle are divided between two separate cylinders, including a compression cylinder for intake and compression, and a power cylinder, for power and exhaust. The two cylinders are connected by a passage including a thermal regenerator. Exhaust gasses from the power cylinder are used to heat the regenerator. Air from the compression cylinder is heated by the regenerator as it moves through the passage into the power cylinder.

These prior art devices require mechanically complex regenerators or heat exchangers, or specialized cylinders to carry out particular phases of an engine cycle. None of these devices can be integrated into, or retrofit onto, standard Otto cycle, Diesel cycle, or other internal combustion engines. There is a need for a simple heat transfer device that is readily integrated into existing production engine designs or retrofit onto an existing engine after production.

SUMMARY OF THE INVENTION

The present invention provides a heat transferring engine valve reciprocatingly received within the cylinder of an internal combustion engine, including a valve head having a combustion surface directed toward a combustion chamber of the cylinder, and a heat transferring member situated at the combustion surface of the valve head and extending toward the combustion chamber. The heat transferring member absorbs heat from the combustion chamber during the power stroke of an engine cycle and releases the absorbed heat into the combustion chamber during at least the compression stroke of a succeeding engine cycle. The present invention also provides a heat transferring member affixable to the combustion face of a gas exchange valve of an internal combustion engine. The present invention further provides an internal combustion engine cylinder including at least one heat transferring valve. The present invention still further provides a method for increasing the efficiency of combustion in an internal combustion engine, including the steps of providing the valve head of at least one engine valve with a heat transferring member, exposing the heat transferring member to heat of combustion in a combustion chamber during the power stroke of an engine cycle, absorbing heat of combustion into the heat transferring member, releasing heat absorbed heat of combustion from the heat transferring member into the combustion chamber during the succeeding compression stroke of the engine cycle, raising the temperature of the combustion chamber during the compression stroke, and increasing the efficiency of combustion.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

Figure 1A:
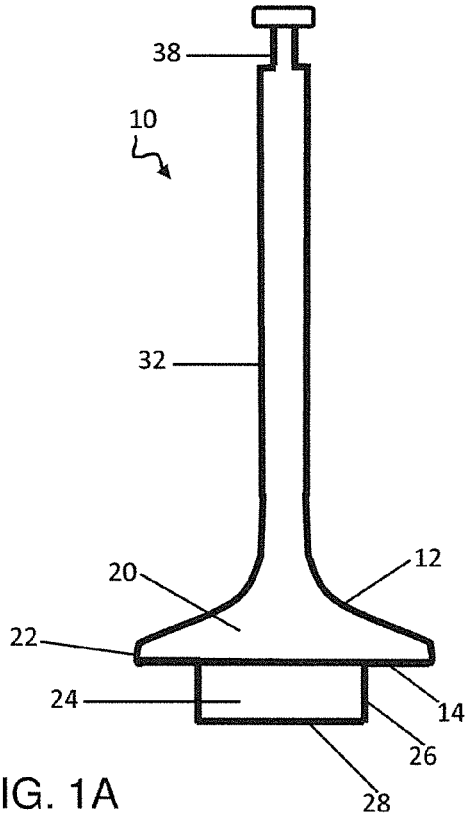
FIG. 1A shows a side view of a heat transferring valve according to the present invention, with a heat transferring member affixed to the valve head.

A heat transferring gas exchange valve according to the present invention, generally shown at 10, includes a generally ovoid or circular valve head 12 including a lower combustion surface 14 directed toward the combustion chamber 16 of a cylinder 18, an opposite upper surface 20, a circumferential margin 22, and a heat transferring member 24 situated at the combustion surface 14 and extending toward the combustion chamber 16. The heat transferring member 24 includes at least one lateral side 26 and a face 28 directed toward the combustion chamber 16.

In the following description, the term "conventional valve" refers to any engine gas exchange valve that does not include a heat transferring member 26.

Figure 6:
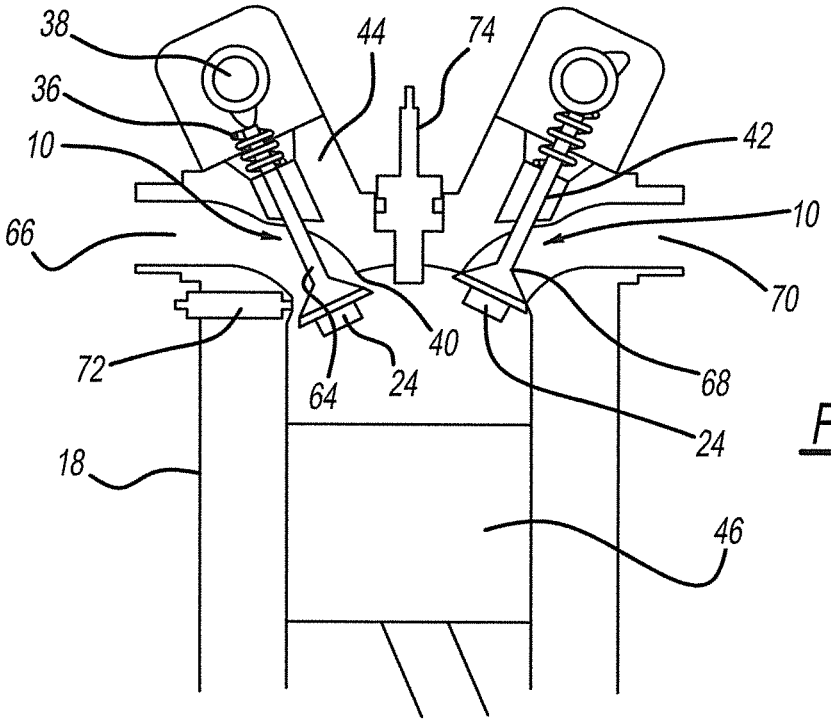
FIG. 6 shows an engine cylinder including a heat transferring intake valve and a heat transferring exhaust valve.

A exemplary heat transferring valve 10, as shown in FIGS. 1A and 6, is preferably a poppet valve reciprocatingly receivable within a valve guide 30 of a cylinder 18. The heat transferring valve 10 also includes support and mounting structures well known in engine valve art, including an elongated rod-like stem portion 32 connecting the valve head 12 to an opposite valve tip portion 34. The valve tip portion 34 can be adapted to retain a valve spring 36 and to operatively link the valve 10 indirectly to a camshaft 38, solenoid, or other valve driver (not shown). The circumferential margin 22 of the valve head 12 interfaces with a valve seat 40 situated at the terminus of the valve guide 42

The heat transferring valve 10 increases the efficiency of combustion by transferring heat generated during the power stroke of an engine cycle to the succeeding compression stroke. That is, the heat transferring member 24 of the heat transferring valve 10 absorbs a portion of the combustive heat produced during the power stroke and releases the heat into the relatively cool gaseous environment of the succeeding compression stroke. The release of heat can occur by radiation from the heat transferring member 24; by conduction upon contact of the heat transferring member with surrounding gasses; or by both mechanisms. This heat transfer increases the temperature of the combustion chamber during the compression stroke. This in turn reduces the amount of unburned or incompletely burned hydrocarbon fuel, thereby increasing fuel mileage and reducing engine emissions. Depending on ambient temperatures in the combustion chamber of a particular engine, the heat transferring member 24 can continue to absorb heat during the exhaust stroke that follows a power stroke, and it can begin to release absorbed heat into the combustion chamber during the intake stroke that precedes a compression stroke.

The heat transferring member 24 is a simple stationary part which performs a heat transfer function that was hitherto accomplished only by complex and cumbersome heat regenerators and divided cylinder engine designs. Heat transferring valves 10 are readily incorporated into standard valve and cylinder head designs. They can be utilized in precisely the same manner as conventional engine valves, except for the possible requirement of slight additional clearance between the cylinder head 44 and piston 46 to prevent contact between the heat transferring member 24 and the piston 46. A heat transferring valve 10 can be fabricated as a unit including a heat transferring member 24. Alternatively, an existing conventional engine valve can be converted into a heat transferring valve 10 by the affixation of a heat transferring member 24 to the combustion surface 14 of the valve head 12.

Figures 2A, 2B, 2C, 2D:
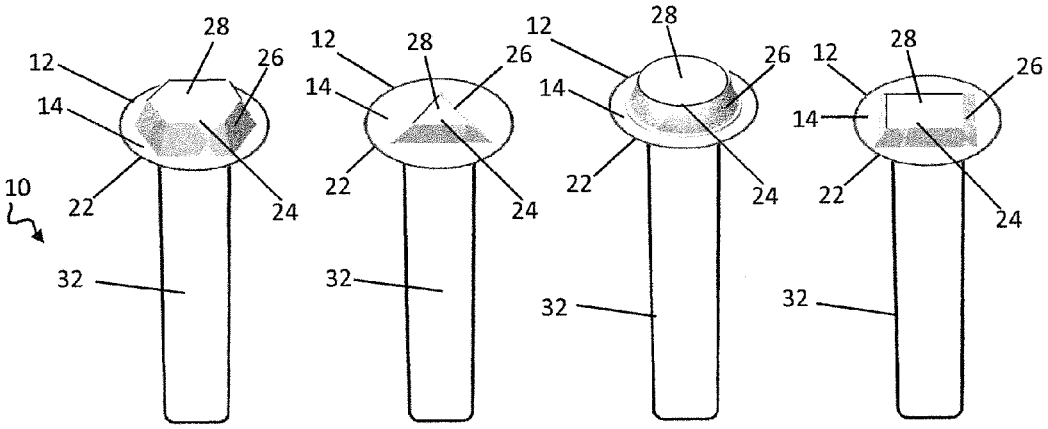
FIG. 2A shows an oblique elevation of a heat transferring valve including a hexagonal heat transferring member.
FIG. 2B shows an oblique elevation of a heat transferring valve including a triangular heat transferring member.
FIG. 2C shows an oblique elevation of a heat transferring valve including a circular heat transferring member.
FIG. 2D shows an oblique elevation of a heat transferring valve including a rectangular heat transferring member.
Figures 3A, 3B, 3C, 3D:
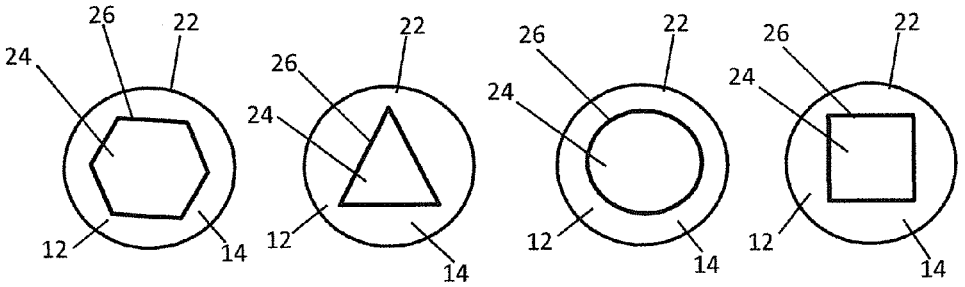
FIG. 3A shows a top elevation of a heat transferring valve including a hexagonal heat transferring member.
FIG. 3B shows a top elevation of a heat transferring valve including a triangular heat transferring member.
FIG. 3C shows a top elevation of a heat transferring valve including a circular heat transferring member.
FIG. 3D shows a top elevation of a heat transferring valve including a rectangular heat transferring member.
Figure 3E:
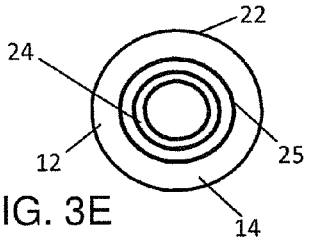
FIG. 3E shows a top elevation of a heat transferring valve including a heat transferring member in the form of concentric rings.

In a preferred embodiment, the center of the heat transferring member 24 is situated concentric to the center of the combustion surface 14 and extends from the combustion surface 14 as a steep-shouldered, flat-faced, mesa-like projection. The perimeter of the heat transferring member 24 is preferably polygonal, most preferably hexagonal, to maximize surface area for absorbing and releasing heat, as shown in FIGS. 2A and 3A. The perimeter of the heat transferring member 24 can alternatively be of any shape, including but not limited to triangular, rectangular, and circular, as show in FIGS. 2B to 2D and 3B to 3D. The heat transferring member 24 can also include a plurality of concentric heat transferring units 25, as shown in FIG. 3E. The heat transferring member 24 can extend over any desired proportion of the surface area of the combustion surface 14, but preferably does not extend to the margins 22 of the valve head 12. Lack of contact of the heat transferring member 24 with the margins 22 minimizes the loss of heat by conduction to the valve seat 40 and cylinder head 44, and maximizes release of heat into the combustion chamber 16. The lateral sides 26 of the heat transferring member 24 can be sloped at any desired angle relative to the combustion surface 14 of the valve head 12, as shown in FIGS. 2A to 2D, including perpendicular to the combustion surface 14, as shown in FIG. 1A. The thickness of the heat transferring member 24, can be any thickness required to perform a desired level of heat transfer while avoiding contact with the piston 46 at the top of its travel.

Figure 1B:
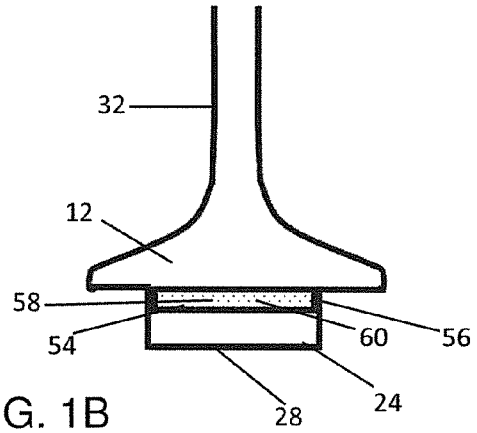
FIG. 1B shows a longitudinal section of a heat transferring valve, wherein the heat transferring member includes an insulation chamber.
Figure 1C:
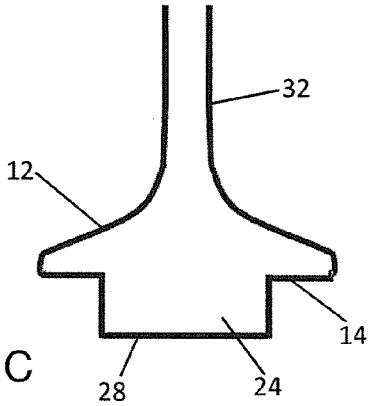
FIG. 1C shows a side view of a heat transferring valve, wherein the heat transferring member is formed as a single unit with a valve head.
Figure 4A:
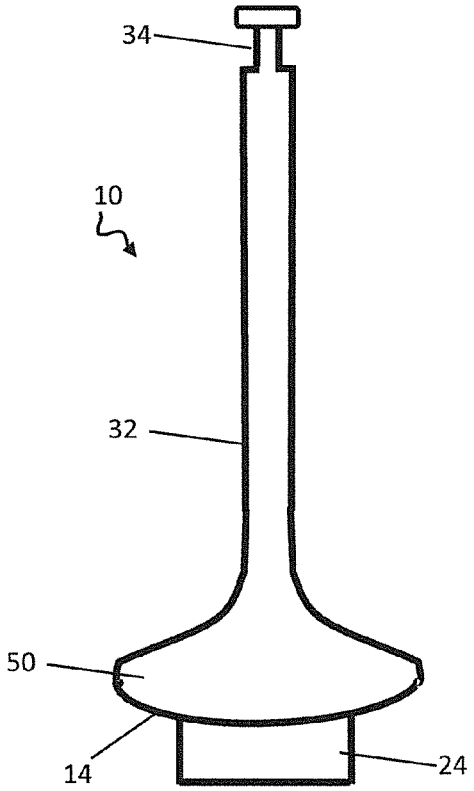
FIG. 4A shows a side view of a heat transferring valve including a convex valve head.
Figure 4B:
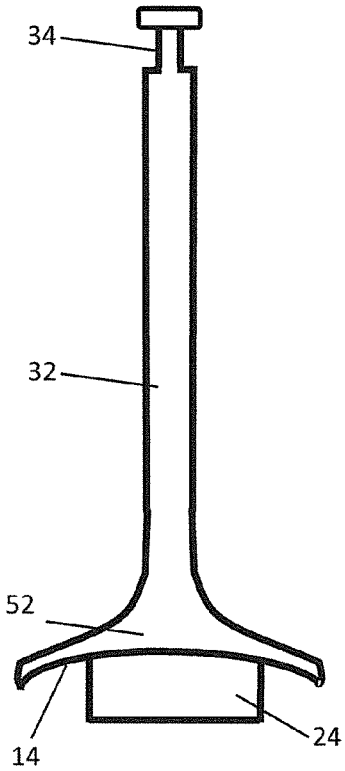
FIG. 4B shows a side view of a heat transferring valve including a concave valve head.

The heat transferring member 24 of the present invention is not limited to inclusion in a flat-surfaced valve head 12 as shown in FIGS. 1A to 1C. In a convex valve head 50, the heat transferring member 24 extends from the convex arc that defines the combustion surface 14 of the convex shaped valve head 50, as shown in FIG. 4A. In a concave valve head 52, the heat transferring member 24 extends from the concave arc that defines the combustion surface 14 of the concave valve head 54, as shown in FIG. 4B.

In one embodiment, the heat transferring valve 10 includes an insulation chamber 54 basally situated within the heat transferring member 24, as shown in FIG. 1B. The insulation chamber 54 prevents the wasteful conduction of absorbed heat into the stem portion 32 of the heat transferring valve 10, and away from the heat transferring member 24. The insulation chamber includes at least one chamber wall 56 defining an interior space 58. The interior space 58 can be filled with any known insulation material 60, including air, an inert gas, or a liquid or solid heat insulating material such as fiberglass.

The heat transferring member 24 is preferably composed of stainless steel but can alternatively be composed of any metallic material having appropriate durability and heat transfer properties, including but not limited to carbon steel, aluminum, and titanium. The heat transferring member 24 can alternatively be composed of a nonmetallic material, such as a high temperature ceramic including but not limited to silicon nitride, silicon carbide, silicon dioxide, and a cermet (ceramic sintered with metal) (Kyocera Industrial Ceramics Corporation San Diego, Calif. The heat transferring member 24 can be composed of the same material as the valve head 12 or of a different material. Any of the components of the heat transferring valve 24, including the valve head 12, stem portion 32, and tip portion 34, can be hollow bodied or solid-bodied.

Figure 5:
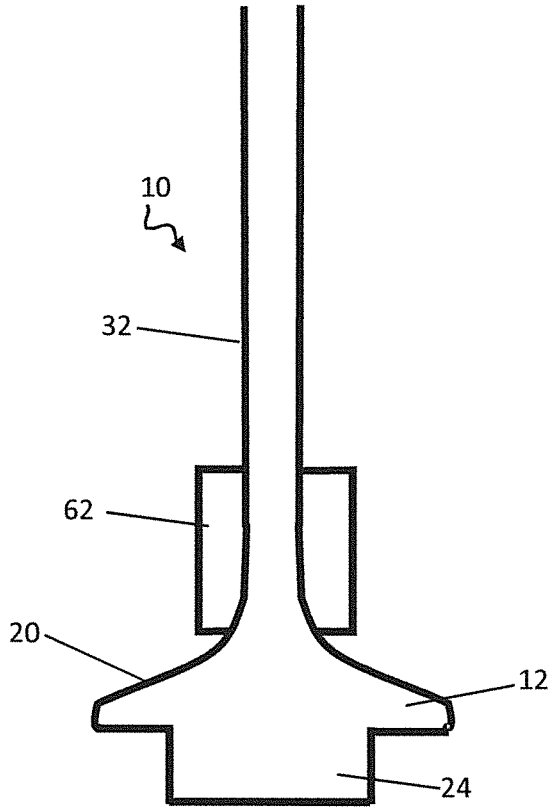
FIG. 5 shows a longitudinal section of a heat transferring valve including a heat transferring collar.

A heat transferring valve 10 according to the present invention can additionally include a heat transferring collar 62 circumferentially situated about the stem portion 32 of the valve 10 and in contact with the upper surface 20 of the valve head 12, as shown in FIG. 5. The heat transferring collar 62 enhances the ability of the heat transferring valve 10 to absorb heat produced during the power stroke of an engine cycle and release it during the compression stroke of the succeeding compression cycle. It can extend for any desired distance along the stem portion 32. The heat transferring collar 62 can be composed of any material with suitable heat transfer and durability properties, as previously described for the heat transferring member 24. The heat transferring collar 62 can be composed of the same material as the heat transferring member 24, or it can be composed of a different material. The heat transferring collar 62 can be formed as a single unit with the heat transferring valve 24, or it can alternatively be affixed to the stem portion 32, and upper surface 20 of a valve head 12 of an existing heat-transferring valve 24.

The present invention also includes an engine cylinder 18 wherein at least one gas exchange valve is a heat transferring gas exchange valve 10, as previously described. An exemplary cylinder 18 according to the present invention, shown in FIG. 6, includes at least one intake valve 64 regulating at least one intake port 66, at least one exhaust valve 68 regulating at least one exhaust port 70, a fuel injector 72 or other means for introducing fuel into the cylinder 18, a movable piston 46, connected to a crankshaft (not shown) or other linkage for producing reciprocating linear motion, and optionally, a spark plug 74 or other ignition means. In the exemplary cylinder 18, at least one intake valve 64 and at least one exhaust valve 68 are heat transferring valves 10. The heat transferring members 24 preferably protrude past the valve seat 40 for maximum exposure to the combustion chamber 16, but alternatively can be flush with or recessed from the valve seat 40.

Figure 7:
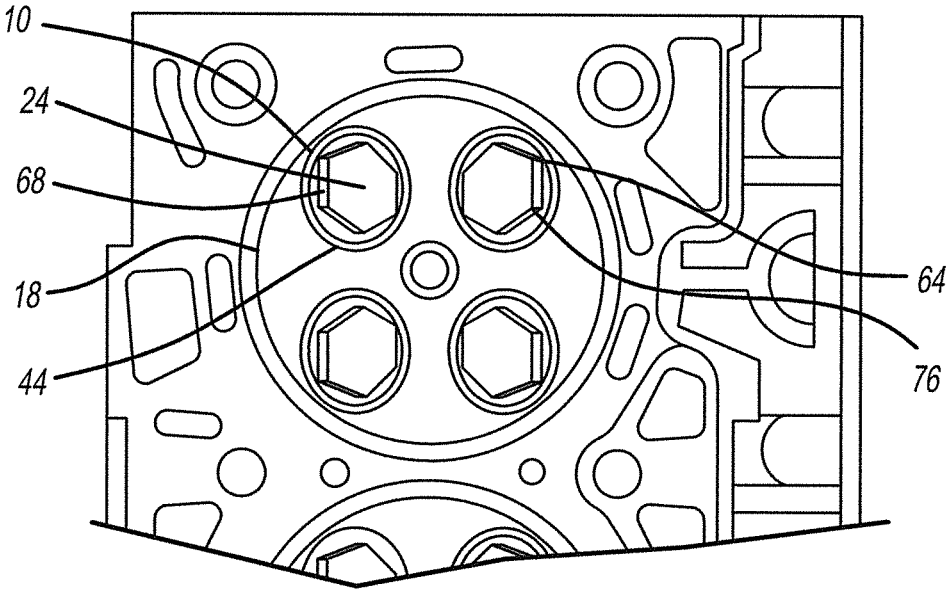
FIG. 7 shows a photograph of an engine cylinder including two heat transferring exhaust valves and two conventional intake valves.

Cylinders 18 including any number and combination of conventional valves 76 and heat transferring valves 10 are encompassed by the present invention. Increases in fuel mileage have been observed with a four-valve cylinder head wherein the exhaust valves 68 are heat transferring valves 10, and the intake valves 64 are conventional valves 76 as shown in FIG. 7. It will be understood that the optimal proportion of heat transferring and conventional valves can be determined according to the desired temperature of a particular combustion chamber. The proportion of heat retaining valves can be increased if insufficient temperatures are reached, and the proportion can be decreased if the combustion chamber temperature proves to be too high for maximal combustion efficiency or optimal engine wear.

The exemplary cylinder shown in FIG. 6 is depicted as a cylinder head of a four-stroke Otto cycle engine, but heat transferring valves 10 are equally applicable to other piston engine designs, including but not limited to two stroke and Diesel cycle engines.

The present invention also include a method for increasing the efficiency of combustion in an internal combustion engine, including the steps of: providing the valve head 12 of at least one engine valve with a heat transferring member 24; exposing the heat transferring member 24 to a combustion chamber 16 of the engine during the power stroke of an engine cycle; absorbing heat generated during the power stroke into the heat transferring member 24; exposing the heat transferring member 24 to the combustion chamber 16 during the succeeding compression stroke of the engine cycle; releasing heat from the heat transferring member 24 into the combustion chamber during the compression stroke; raising the temperature of the combustion chamber during the compression stroke; and increasing the efficiency of combustion.

The heat transferring valve of the present invention need not be limited to use as a gas exchange valve in an internal combustion engine. The valve can be used in any device wherein a valve head is sequentially exposed to a fluid having a first temperature and to a fluid having a second, lower temperature. In such a device, the heat transferring member will absorb heat from the fluid having the first temperature and release the heat into the fluid having the second, lower temperature. The fluid can be a gas, a liquid, or a flowable solid.

While illustrative embodiments of the invention have been disclosed herein, it is understood that other embodiments and modifications may be apparent to those of ordinary skill in the art.

REFERENCES

U.S Pat. No.
6,340,004
European Patent No.
EP0717183

The invention claimed is:

1. A heat transferring engine valve reciprocatingly received within the cylinder of an internal combustion engine, including:

a valve head having a combustion surface directed toward a combustion chamber of said cylinder; and a heat transferring member situated at said combustion surface of said valve head and extending toward said combustion chamber;

said heat transferring member absorbing heat of combustion from said combustion chamber during at least the power stroke of an engine cycle;

said heat transferring member releasing absorbed heat into said combustion chamber during at least the compression stroke of a succeeding engine cycle;

said heat transferring member including at least one lateral side and a face directed toward said combustion chamber;

said heat transferring engine member additionally including a basal insulating chamber defining an interior space filled with a heat insulating material.

2. The heat transferring engine valve according to claim 1, wherein said heat insulating material is selected from the group consisting of air, an inert gas, a liquid insulator, and a solid insulator.

3. A heat transferring engine valve reciprocatingly received within the cylinder of an internal combustion engine, including:

a valve head having a combustion surface directed toward a combustion chamber of said cylinder; and a heat transferring member situated at said combustion surface of said valve head and extending toward said combustion chamber;

said heat transferring member absorbing heat of combustion from said combustion chamber during at least the power stroke of an engine cycle;

said heat transferring member releasing absorbed heat into said combustion chamber during at least the compression stroke of a succeeding engine cycle;

wherein said heat transferring member is defined as a plurality of concentric heat transferring units, each of said plurality of units having a shape selected from the group consisting of a polygon and a circle.

4. A heat transferring engine valve reciprocatingly received within the cylinder of an internal combustion engine, including:

a valve head having a combustion surface directed toward a combustion chamber of said cylinder; and a heat transferring member situated at said combustion surface of said valve head and extending toward said combustion chamber;

said heat transferring member absorbing heat of combustion from said combustion chamber during at least the power stroke of an engine cycle;

said heat transferring member releasing absorbed heat into said combustion chamber during at least the compression stroke of a succeeding engine cycle;

said heat transferring engine valve additionally including a valve stem and a heat transferring collar circumferentially situated about said valve stem and in contact with said valve head.

5. The heat transferring engine valve according to claim 4, wherein said heat transferring collar is formed as a single unit with said valve stem and valve head.

6. The heat transferring engine valve according to claim 4, wherein said heat transferring collar is affixed to said valve stem and said valve head.

7. A heat transferring member affixable to the combustion face of an engine valve of an internal combustion engine, said heat transferring member extending toward said combustion chamber;

said heat transferring member absorbing heat of combustion from said combustion chamber during at least the power stroke of an engine cycle;

said heat transferring member releasing absorbed heat into said combustion chamber during at least the compression stroke of a succeeding engine cycle;

said heat transferring member additionally including a basal insulating chamber defining an interior space filled with a heat insulating material.

8. The heat transferring member according to claim 7 wherein said heat insulating material is selected from the group consisting of air, an inert gas, a liquid insulator, and a solid insulator.

9. A heat transferring member affixable to the combustion face of an engine valve of an internal combustion engine, said heat transferring member extending toward said combustion chamber;

said heat transferring member absorbing heat of combustion from said combustion chamber during at least the power stroke of an engine cycle;

said heat transferring member releasing absorbed heat into said combustion chamber during at least the compression stroke of a succeeding engine cycle;

said heat transferring member being further defined as a plurality of concentric heat transferring units, each of said plurality of units having a shape selected from the group consisting of a polygon and a circle.

10. An internal combustion engine cylinder including a plurality of engine valves, wherein at least one of said engine valves is a heat transferring valve, said heat transferring valve including:

a valve head having a combustion surface directed toward a combustion chamber of said cylinder;

a heat transferring member situated at said combustion surface of said valve head and extending toward said combustion chamber;

said heat transferring member absorbing heat of combustion from said combustion chamber during at least the power stroke of an engine cycle;

said heat transferring member releasing absorbed heat into said combustion chamber during at least the compression stroke of a succeeding engine cycle;

wherein said at least one heat transferring valve is an intake valve.

11. An internal combustion engine cylinder including a plurality of engine valves, wherein at least two of said engine valves is a heat transferring valve, each of said at least two heat transferring valves including:

a valve head having a combustion surface directed toward a combustion chamber of said cylinder;

a heat transferring member situated at said combustion surface of said valve head and extending toward said combustion chamber;

said heat transferring member absorbing heat of combustion from said combustion chamber during at least the power stroke of an engine cycle;

said heat transferring member releasing absorbed heat into said combustion chamber during at least the compression stroke of a succeeding engine cycle;

wherein said at least two heat transferring valves include at least one intake valve and at least one exhaust valve.

* * * * *